United States Patent [19]

Emery et al.

[11] Patent Number: 4,854,234

[45] Date of Patent: Aug. 8, 1989

[54] INK FOUNTAIN CLOSURE SYSTEM

[75] Inventors: David C. Emery, York, Me.; David G. Field; Derek C. Leck, both of Dover, N.H.

[73] Assignee: Harris Graphics Corporation, Dover, N.H.

[21] Appl. No.: 177,060

[22] Filed: Apr. 4, 1988

[51] Int. Cl.[4] ..... B41F 31/06

[52] U.S. Cl. ..... 101/364; 101/365

[58] Field of Search ..... 101/364, 365

[56] References Cited

U.S. PATENT DOCUMENTS

| | | | |
|---|---|---|---|
| 3,116,688 | 1/1964 | Ward, Jr. et al. | 101/365 X |
| 4,505,309 | 3/1985 | Adelman et al. | 141/97 |
| 4,676,160 | 6/1987 | Linska | 101/365 |

FOREIGN PATENT DOCUMENTS

| | | | |
|---|---|---|---|
| 1416866 | 9/1965 | France | 101/365 |

OTHER PUBLICATIONS

*Compressed Air and Gas Handbook*, Rollins, John P., (Ed.), (Compressed Air and Gas Institute 1973), pp. 9–28, 9–36.

*Primary Examiner*—Edgar S. Burr
*Assistant Examiner*—James Lisehora
*Attorney, Agent, or Firm*—Tarolli, Sundheim & Covell

[57] ABSTRACT

An apparatus for closing an ink fountain on a printing press, the press having a fountain roll rotatable relative to a supply of ink and a flexible fountain blade adjacent thereto and spaced apart from the roll by a small gap. The size of the gap is controlled by a series of ink keys which move blade sections toward or away from the roll. When the press is to be shut down, the gap is closed by moving the blade against the roll in order to prevent ink leakage from the fountain. To do this, a bladder located adjacent the blade is inflated, forcing the entire length of the blade against the roll and thus closing the gap. The inflatable bladder operates independently of the ink keys, so that the keys need not be closed or adjusted when the press is shut down. When the press is restarted, the bladder deflates, allowing the blade to move away from the roll and to be controllable by the ink keys again.

9 Claims, 2 Drawing Sheets

INK FOUNTAIN CLOSURE SYSTEM

BACKGROUND OF THE INVENTION

1. Field of the Invention

The present invention relates to ink fountains for printing presses. In particular, the present invention relates to an apparatus for closing off an ink fountain when the printing press shuts down, to prevent leakage of ink from the fountain.

2. Description of the Prior Art

An ink fountain assembly in a printing press typically includes a fountain roll which rotates in a supply of ink. As the fountain roll rotates, it picks up ink from the supply of ink, then transfers this ink to other rolls in the printing press and ultimately to the printing plate and to the material to be printed. A typical fountain assembly also includes a fountain blade adjacent the fountain roll, extending along the axial extent of the fountain roll and spaced apart from the fountain roll by a small distance or gap. The fountain blade and the adjacent curved surface of the fountain roll form a chamber within which is maintained a reservoir of ink. The gap between the blade and the roll is adjustable to control the amount of ink which is retained on the fountain roll after it rotates through the ink supply and before it contacts the next roll in the press. The gap is adjusted by a series of ink keys which move respective sections of the blade toward or away from the roll to vary the gap between the individual sections of the blade and the roll, thus forming an ink film having a desired thickness profile on the roll.

When a printing press is shut down, this gap between the fountain blade and the fountain roll must be closed in order to prevent ink from leaking out of the fountain. The gap is usually closed by moving the fountain blade so that it is disposed against the fountain roll, along its entire length. This is done by closing each of the ink keys spaced along the blade. If every ink key is closed down completely, the entire length of the blade is moved against the roll, thus closing the gap as desired.

Closing the gap by closing all the ink keys, however, can be time-consuming. Also, whatever settings the keys were at before closing, is lost, and all the keys must be reset once the press is started up again.

SUMMARY OF THE INVENTION

The present invention provides an apparatus for closing the gap between a fountain roll and a fountain blade in a printing press, without adjusting or closing the ink keys which are normally used to set the gap. In accordance with the present invention, an inflatable bladder is mounted on the fountain assembly near the fountain blade. The bladder extends axially along the length of the blade. When the press is shut down, a valve is opened and the bladder is supplied with a pressurized gas such as air. The bladder inflates, forcing the blade away from the ink keys and against the fountain roll along its entire length, thus closing the gap between the roll and the blade and preventing ink from leaking out of the ink fountain.

When it is desired to restart the printing press, the valve is closed and the pressurized gas supply to the bladder is cut off. Gas from the bladder bleeds out through the valve, the bladder deflates, and the blade, which is biased away from the roll, returns to its original position as set by the ink keys. This reopens the gap between the blade and the roll, and allows the fountain roll to pick up ink from the fountain again.

In a preferred embodiment of the present invention, each ink key is associated with and controls the position of a separate section of the fountain blade. A separate, pivotally mounted actuating lever is interposed between each key and its associated blade section. Whenever an ink key is adjusted, it moves its respective actuating lever, which pivots and moves the associated blade section toward or away from the fountain roll. Each actuating lever is also interposed between the inflatable bladder and the fountain blade. When the bladder is inflated, it simultaneously actuates all the actuating levers, lifting them off the ink keys and thus forcing all the blade sections against the fountain roll. This closes the entire gap at once, without moving any of the ink keys. When the bladder is deflated, the bias of the blade away from the roll moves the blade away from the roll and causes the actuating levers to return to their original positions against the ink keys.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
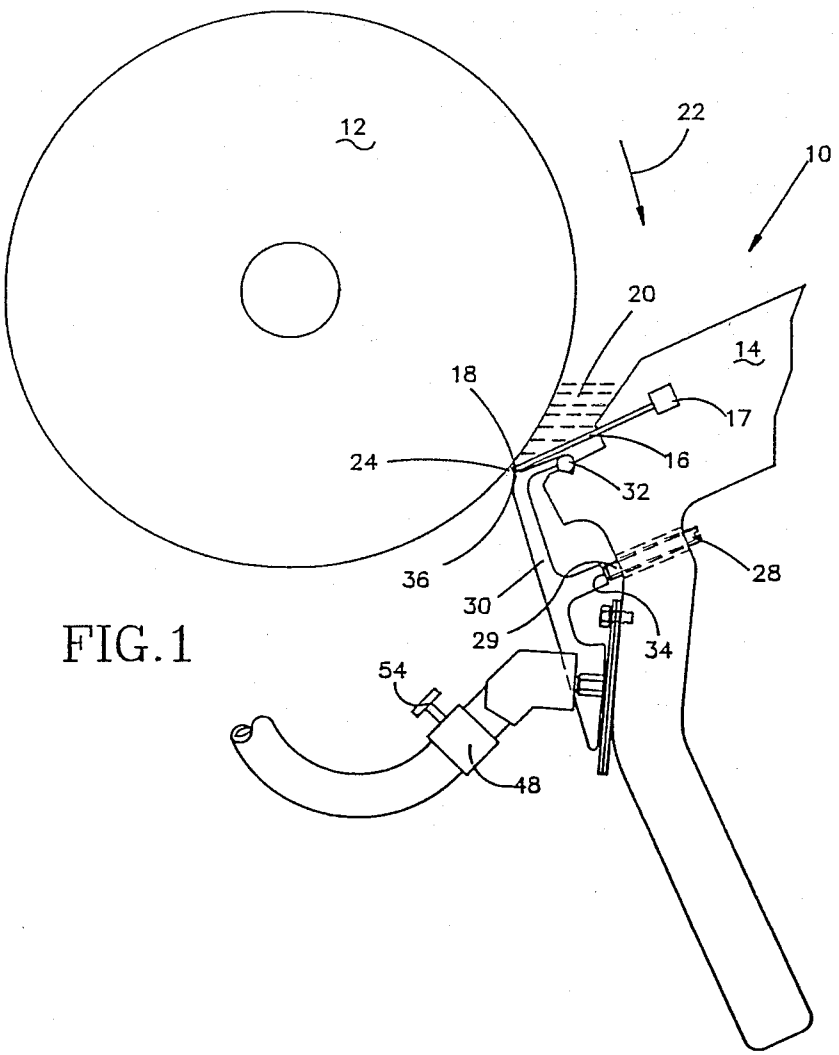
FIG. 1 is a schematic side view of a fountain assembly incorporating the present invention.

FIG. 1 shows an ink fountain assembly 10 for supplying ink to a fountain roll 12 in a printing press. The printing press includes a frame member 14 from which a flexible fountain blade 16 is suspended at 17 with its lower edge 18 in close proximity to the fountain roll 12. The fountain blade 16 and the adjacent curved surface of the fountain roll 12 form a chamber within which is a reservoir 20 of ink. Blade 16 is biased away from roll 12 by the inherent stiffness of blade 16 and by the weight of the ink in the reservoir 20.

During operation of the press, the fountain roll 12 rotates in the direction indicated by arrow 22, and ink from the reservoir 20 flows through a gap 24 between the fountain roll 12 and the lower edge 18 of the blade 16. This creates a film of ink on the surface of the roll 12, whose thickness at any point on the roll is determined by the spacing of the blade edge 18 from the surface of roll 12 at that point. Thus, as is known, by controlling the size of the gap 24, an ink film having a desired thickness profile can be maintained across the roll 12.

The size of the gap 24 between the blade 16 and the roll 12 is controlled by a series of ink keys which are positioned at locations spaced laterally along the fountain assembly. FIG. 1 shows one such ink key 28. The key 28 is rotatably and threadedly mounted in frame member 14, with a key tip 29 projecting beyond frame member 14. An actuating lever 30 is pivotally mounted at 32 on frame member 14. The key tip 29 abuttingly contacts a first surface 34 on the actuating lever 30.

When the threaded key 28 is rotated, the tip 29 of the key is advanced or retracted depending upon the direction of rotation as desired, thereby effecting pivoting of actuating lever 30 about mounting point 32. A second surface 36 of actuating lever 30 is in contact with the lower edge 18 of the fountain blade 16, so that as actuating lever 30 thus pivots, the lower edge 18 of the blade 16 also moves. This controls the width of the gap 24 between the blade edge 18 and the fountain roll 12.

Figure 2:
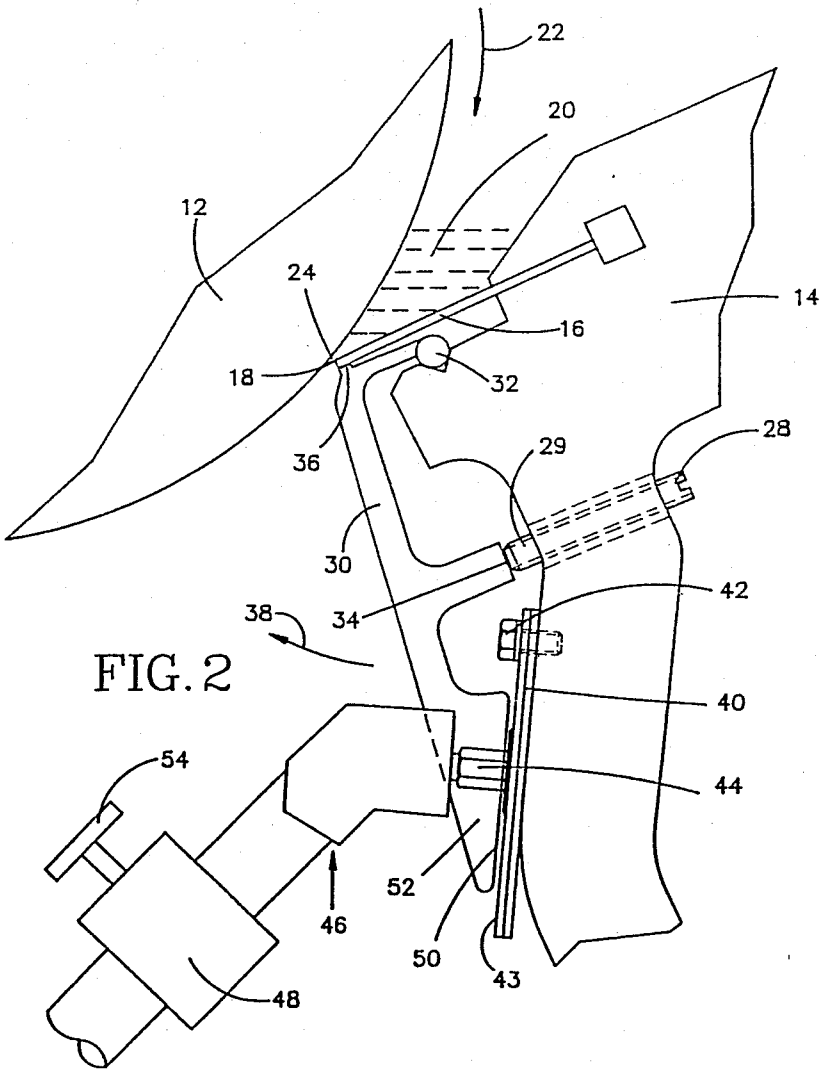
FIG. 2 is an enlarged schematic side view of the fountain assembly of FIG. 1, showing a gap between the fountain roll and the fountain blade, with the bladder deflated and the position of an actuating lever controlled by an ink key.

During operation of the printing press (see FIG. 2), the fountain roll 12 rotates in the direction indicated by arrow 22, and a small gap 24 is maintained between the blade edge 18 and the fountain roll 12. When the printing press is shut down, however, the gap 24 between the blade edge 18 and the fountain roll 12 must be closed, in order to prevent leakage of ink from the reservoir 20 through the gap 24 between the blade 16 and the roll 12.

In accordance with the present invention, the gap 24 is closed by causing actuating lever 30 to pivot in the direction indicated by arrow 38 (FIG. 3), sufficiently far so that the second surface 36 of the actuating lever 30 forces the lower edge 18 of the blade 16 completely against the surface of fountain roll 12. In the present invention this is accomplished by means of an inflatable bladder 40 which, when inflated, pivots actuating lever 30, as described, to thus move blade 16 against roll 12.

The inflatable bladder 40 (FIGS. 2, 3, 4) is secured by a plurality of screws 42 to frame member 14. An air supply connection 44 for bladder 40 is connected to an air supply line 46. A solenoid actuated valve 48 is disposed in air supply line 46. The outer surface 43 of the bladder 40 contacts a third surface 50 on the lower end 52 of actuating lever 30.

Figure 3:
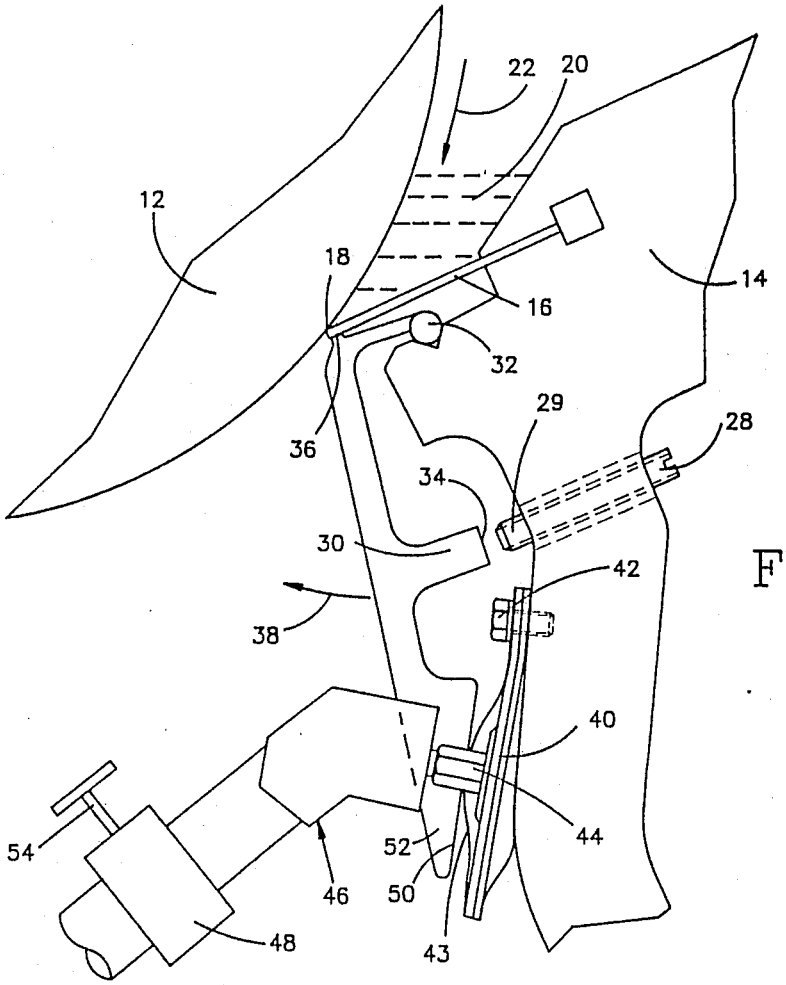
FIG. 3 is a view similar to FIG. 2 and showing the bladder inflated.

When the printing press is shut down, valve 48 (FIG. 3) is opened, allowing pressurized air to flow through supply line 46 and supply connection 44 to bladder 40. The bladder 40 then inflates, and the outer surface 43 of bladder 40 pushes against a third surface 50 on actuating lever 30. This causes actuating lever 30 to pivot outwardly from frame member 14 in the direction indicated by arrow 38. As the actuating lever 30 pivots, the second surface 36 of actuating lever 30 forces the lower blade edge 18 toward fountain roll 12. Actuating lever 30 is dimensioned so that when bladder 40 is fully inflated, as shown in FIG. 3, the lower edge 18 of the fountain blade 16 is forced against fountain roll 12 to close the gap 24 between the blade and the roll.

It can be seen that, in accordance with the present invention, the gap 24 between the blade 16 and the roll 12 may be closed without closing or otherwise adjusting the ink keys 28. In FIG. 3, the gap 24 between the fountain blade 16 and the fountain roll 12 is shown in the closed position. Actuating lever 30 is lifted off the tip 29 of ink key 28. Ink key 28 has not been adjusted at all, in order to close the gap.

When the printing press is to be started up again, valve 48 is closed, closing off the supply of pressurized air to bladder 40. The air which was within bladder 40 bleeds off through a bleed opening 54 in valve 48. Bladder 40 deflates, and the bias of blade 16 away from fountain roll 12 pushes blade edge 18 away from fountain roll 12, moving actuating lever 30 back to the position shown in FIG. 2 wherein it rests on and is controllable by ink key 28.

Figure 4:
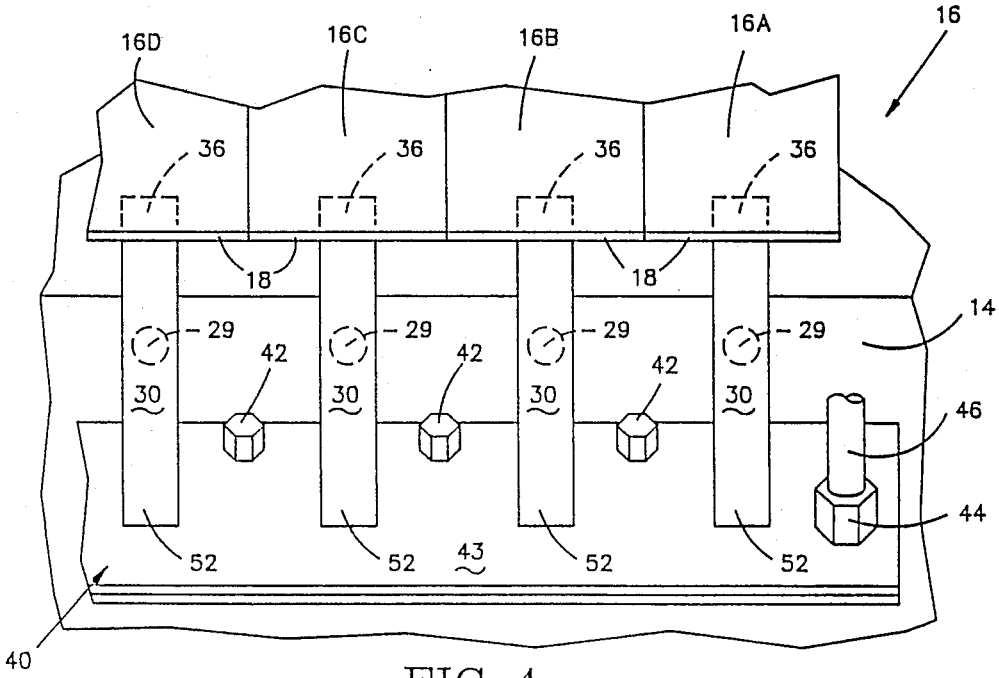
FIG. 4 is a partial schematic plan view showing several actuating levers interposed between the fountain blade and the bladder.

FIG. 4 shows the relationship between the bladder 40, the actuating levers 30, and the fountain blade 16. In FIG. 4 the fountain blade 16 is shown schematically as having a plurality of blade sections 16A, 16B, 16C, and 16D, each with a lower blade edge 18. Associated with each blade section is a separate actuating lever 30. The second surface 36 of each actuating lever 30 is in contact with the blade sections 16A through 16D. The third surface 52 of each actuating lever 30 is in contact with outer surface 43 of bladder 40. Located behind each actuating lever 30 is an ink key tip 29. When the bladder 40 is inflated, all of the actuating levers 30 simultaneously move, to move each blade section 16A–D toward the roll 12.

Fountain blade 16 may be constructed in several different manners. As noted above, blade 16 is flexible so that separate sections of the blade 16 can be spaced apart from fountain roll 12 at varying distances along its axial extent. To this end, blade 16 may be made of one piece of relatively flexible material. Alternatively, it may be one piece of material which is partially split or slotted in its transverse direction, as by a laser, to provide separate blade segments or sections 16A, 16B, 16C, 16D (FIG. 4). Also, blade 16 may be formed of individual blade segments which are secured together at their transverse ends opposite lower blade edge 18. The present invention is usable with any of these types of fountain blades, with one actuating lever 30 being associated with each blade segment or section.

Bladder 40 may be made from any suitable solvent resistant elastomer since it may be exposed to an ink solvent during clean-up of the press. It is desirable that bladder 40 inflate uniformly along its entire length (see FIG. 4), so that all of the actuating levers 30 are moved uniformly, thus evenly closing the entire length of the gap 24 between the fountain blade 16 and fountain roll 12.

The present invention also contemplates the use of an inflatable bladder 40 to close off a specific partial area of an ink fountain where a minimum amount of ink coverage is required. In such a case, bladder 40 would be made up of more than one separate section, each such section controlling one or more actuating levers 30. Each bladder section would have its own controllable pressurized air supply. Thus, a given area of the ink fountain could be closed off as desired by inflating the desired bladder section or sections. The gap 24 along the entire length of the ink fountain could be closed as described above by inflating all sections of bladder 40 simultaneously.

The present invention is also usable when the fountain blade 16 is located on top of the foutain roll 12, as well as below the roll 12 as shown in the drawings herein.

From the above description of a preferred embodiment of the invention, those skilled in the art will perceive improvements, changes and modifications. Such improvements, changes and modifications within the skill of the art are intended to be covered by the appended claims.

Having described a preferred embodiment of the invention, we claim:

1. A fluid metering apparatus comprising:

a fountain roll rotatable relative to a supply of fluid;

means for metering fluid on said fountain roll as said fountain roll rotates, said metering means including a fountain blade adjacent to said fountain roll and defining a gap between said blade and said roll;

means for closing completely the gap between said blade and said roll, comprising an inflatable bladder operable when inflated to force said blade against said roll;

at least one ink key means for moving said blade to vary the gap between said blade and said roll, said ink key means being settable at a plurality of settings; and at least one actuating lever interposed between said ink key means and said blade and operable by said ink key means to move said blade;

said actuating lever also being operable by said inflatable bladder, independently of said ink key means, to move said blade against said roll to close completely the gap between said blade and said roll, regardless of and without changing the setting of said ink key means.

2. An apparatus as defined in claim 1 further comprising means for inflating said bladder including means for supplying a gas under pressure to said bladder and valve means for controlling the supply of gas to said bladder, said valve means having a first position in which gas is supplied under pressure to said bladder to keep said bladder inflated, and a second position in which the supply of gas to said bladder is cut off.

3. An apparatus as defined in claim 2 wherein said valve means includes means for bleeding gas from said bladder to allow said bladder to deflate, said means for bleeding gas operating when said valve means is in said second position.

4. An apparatus as defined in claim 1 wherein said flexible blade comprises a single blade split partially along its transverse extent in a plurality of locations so as to provide a plurality of individual blade sections.

5. A fluid metering apparatus comprising:

a fountain roll rotatable relative to a supply of fluid;

means for metering fluid on said fountain roll as said fountain roll rotates, said metering means including a fountain blade adjacent to said fountain roll and defining a gap between said blade and said roll;

a plurality of individually adjustable ink keys spaced along the axial extent of said blade, each said key being operable to move an associated section of said blade relative to said roll and being settable at a plurality of settings to control the gap between the associated section of said blade and said roll;

a plurality of actuating levers associated one with each of said keys, each one of said actuating levers being interposed between its associated key and the blade section associated with said key and being operable by its associated key to move its associated blade section relative to said fountain roll to control the gap between said associated blade section and said fountain roll; and means independent of said keys for closing completely the gap between said blade and said roll comprising an inflatable bladder operable when inflated to force said blade against said fountain roll along the axial extent of said roll;

each one of said actuating levers being interposed between said bladder and said blade and being actuatable by said bladder when said bladder is inflated to move its associated blade section against said roll to close the gap therebetween, said bladder when inflated simultaneously actuating said plurality of actuating levers, independent of said keys, to close completely the gap between said blade and said roll across the axial extent of said roll regardless of and without changing the setting of said ink keys.

6. An apparatus as defined in claim 5 wherein each of said actuating levers is pivotally mounted on a frame member adjacent said blade and includes first surface means for contacting the ink key associated with said actuating lever, second surface means for contacting the section of said blade associated with said actuating lever, and third surface means for contacting said bladder, and wherein actuation of an actuating lever either by its associated key or by inflation of said bladder causes pivotal movement of said actuating lever to thereby force said blade section toward said roll.

7. An apparatus as defined in claim 5 further comprising means for inflating said bladder including means for supplying a gas under pressure to said bladder and valve means for controlling the supply of gas to said bladder, said valve means having a first position in which gas is supplied under pressure to said bladder to keep said bladder inflated, and a second position in which the supply of gas to said bladder is cut off.

8. An apparatus as defined in claim 7 wherein said valve means includes means for bleeding gas from said bladder to allow said bladder to deflate, said means for bleeding gas means operating when said valve means is in said second position.

9. An apparatus as defined in claim 5 wherein said flexible blade comprises a single blade split partially along its transverse extent in a plurality of locations so as to provide a plurality of individual blade sections.

* * * * *